US012110083B2

(12) United States Patent
Sjöblom

(10) Patent No.: US 12,110,083 B2
(45) Date of Patent: Oct. 8, 2024

(54) OUTER DRIVE PROTECTION ARRANGEMENT

(71) Applicant: VOLVO PENTA CORPORATION, Gothenburg (SE)

(72) Inventor: Lars Sjöblom, Västra Frölunda (SE)

(73) Assignee: VOLVO PENTA CORPORATION, Gothenburg (SE)

( * ) Notice: Subject to any disclaimer, the term of this patent is extended or adjusted under 35 U.S.C. 154(b) by 524 days.

(21) Appl. No.: 17/290,868

(22) PCT Filed: Nov. 8, 2018

(86) PCT No.: PCT/EP2018/080616
§ 371 (c)(1),
(2) Date: May 3, 2021

(87) PCT Pub. No.: WO2020/094231
PCT Pub. Date: May 14, 2020

(65) Prior Publication Data
US 2021/0380214 A1 Dec. 9, 2021

(51) Int. Cl.
*B63B 59/04* (2006.01)
*B63H 20/36* (2006.01)
(Continued)

(52) U.S. Cl.
CPC ..... *B63B 59/045* (2013.01); *B63H 20/36* (2013.01); *B63H 21/36* (2013.01); *B63J 2/02* (2013.01)

(58) Field of Classification Search
CPC ..... B63B 59/04; B63B 59/045; B63H 20/36; B63H 21/36; B63J 2/02
See application file for complete search history.

(56) References Cited

U.S. PATENT DOCUMENTS 3,220,374 A * 11/1965 Sloan ..... B63B 59/045 440/71
3,240,056 A 3/1966 Read
(Continued)

FOREIGN PATENT DOCUMENTS

CA 2082434 A1 * 5/1994 ..... B63H 20/36
EP 0729422 B1 6/1998
(Continued)

OTHER PUBLICATIONS

International Search Report and Written Opinion dated Jun. 26, 2019 in corresponding International PCT Application No. PCT/EP2018/080616, 8 pages.
(Continued)

*Primary Examiner* — Ajay Vasudeva
(74) *Attorney, Agent, or Firm* — Venable LLP; Jeffri A. Kaminski

(57) ABSTRACT

An outer drive protection arrangement is attachable to a marine vessel while not immersed in water. The arrangement comprises a rim portion arranged in contact with at least a transom surface and surrounding at least one outer drive and a protective cover attached to the rim portion and enclosing a volume encompassing the at least one outer drive, in order to provide a protective gaseous environment inside the cover. The environment contained within the cover is circulated and maintained at a predetermined atmospheric condition by means of a source of conditioned gas.

13 Claims, 11 Drawing Sheets

(51) Int. Cl.
*B63H 21/36* (2006.01)
*B63J 2/02* (2006.01)

(56) References Cited

U.S. PATENT DOCUMENTS 3,870,875 A * 3/1975 Altimus ..... B60Q 1/30 362/477
4,033,184 A * 7/1977 Christink ..... B63H 20/36 73/118.04
4,998,496 A * 3/1991 Shaw, III ..... B63H 20/36 150/157
5,582,574 A * 12/1996 Cramer ..... A61G 10/026 128/205.26
5,660,136 A * 8/1997 Pignatelli ..... B63H 20/36 116/28 R
5,813,361 A * 9/1998 Milliman ..... B63H 20/36 219/535
2002/0112754 A1 8/2002 Gauger et al.

FOREIGN PATENT DOCUMENTS

FR 2743349 A1 * 7/1997 ..... B63B 59/045
FR 2826929 A1 * 1/2003 ..... B63H 20/36
GB 2441990 A 3/2008

OTHER PUBLICATIONS

International Preliminary Report on Patentability dated Sep. 28, 2020 in corresponding International PCT Application No. PCT/EP2018/080616, 13 pages.
European Office Action dated Apr. 22, 2022 in corresponding European Application No. 18803596.8, 6 pages.

* cited by examiner

OUTER DRIVE PROTECTION ARRANGEMENT

CROSS-REFERENCE TO RELATED APPLICATIONS

This application is a U.S. National Stage application of PCT/EP2018/080616, filed Nov. 8, 2018, and published on May 14, 2020, as WO 2020/094231 A1, all of which is hereby incorporated by reference in its entirety.

TECHNICAL FIELD

The invention relates to an outer drive protection arrangement attachable to a marine vessel. The invention relates to a marine equipment protection arrangement for protecting outer drives on marine vessels from rain, salty spray and humid air when the vessel is stored on land, on-board a larger vessel or on an off-shore facility.

The invention is primarily intended for vessels with one or more stern drives and inboard drive engines or motors but can also be applied to vessels with azimuth pod drives, Z-drives or other drives using inboard drive units.

BACKGROUND

Marine equipment such as external drives and propellers are constantly subjected to the corrosive action of winds containing salty spray and humid air when the vessel is stored out of the water, e.g. on land, on-board a larger vessel, or on an off-shore facility. When the vessel is stored and not in use the drive can still be exposed to sea water, high humidity and marine growth. A number of different types of protection arrangements for protecting the outer drives on marine vessels from such corrosive action are available.

EP0729422B1 describes a protective arrangement for vessels transported on trailers towed by a vehicle. This document describes a cover enclosing a drive located outside the hull to reduce the risk of damage. The cover protects the drive from weathering during transport and reduces the risk of theft of parts of the drive. This type of cover does provide some protection from wind, rain and physical action to the drive while the vessel is on land, but does not provide protection from corrosion.

The invention provides an improved protective cover for marine drives and aims to solve the above-mentioned problems.

SUMMARY

An object of the invention is to provide a protective arrangement comprising a protective cover that solves the above-mentioned problems.

It is an object of this invention to provide a novel protection arrangement particularly adapted for use on outer drives on marine vessels during periods of non-use, primarily when the marine vessel is stored out of the water whereby the anode protection is disabled.

It is another object of this invention to provide a marine equipment protection arrangement adapted to be fitted around marine equipment in the form of one or more outer drives which under non-use circumstances are stored or transported out of the water.

It is a further object of this invention to provide a marine equipment protective cover adapted for use on outer drives on vessels not immersed in water, which protection arrangement is adapted to be attached to the transom and/or hull of a vessel to isolate such outer drives from the ambient air surrounding the outer drives. This allows an effective treatment of the atmosphere within the cover in order to inhibit corrosion of the drive when the vessel is stored on land, on-board a larger vessel or on an off-shore facility.

It is a still further object of the invention to provide a marine equipment protection arrangement of uncomplicated design which serves to protect outer drives on boats, the protection arrangement including a frame supporting a flexible envelope which may be easily fitted over the outer drive. The frame comprises a seal held in gas tight contact with a vessel structure such as a transom and/or a portion of the hull to permit treatment of the atmosphere surrounding the outer drive or drives within the cover for the prevention of corrosive action from water or salt and for inhibition of existing or new marine growth.

The object is achieved by a protective cover and a marine vessel.

In the subsequent text, the term "outer drive" is used to denote drive units such as stern drives, azimuth pods, Z-drives and similar drives, driven by an inboard engine or motor. The term excludes drive units such as outboard engines of the type attached directly onto the transom of a marine vessel. The term "gas" is used to denote any suitable gas used as a protective atmosphere surrounding one or more outer drives enclosed by a protective cover according to the invention. A non-exhaustive list of suitable gases can be conditioned ambient air, $CO_2$ or a suitable inert gas such as nitrogen. The protective atmosphere is primarily dehumidified and can also be heated and/or filtered depending on, for instance, surrounding water temperatures or ambient air conditions.

Further, the term "atmospheric conditioning device" is used as an overall description of a device having at least dehumidifying capabilities. Such a device can also have means for heating of and/or filtering particles from the gas forming a protective atmosphere in the protective cover. The atmospheric conditioning device can comprise a single air conditioning unit or multiple units connected in series for treating the gas. The atmospheric conditioning device can be placed externally or on-board the marine vessel, or alternatively be mounted to the frame to which the cover is attached. These terms will be adhered to in the subsequent text, unless otherwise specified. The relative humidity of an air-water mixture is defined as the ratio of the partial pressure of water vapor in the mixture to the equilibrium vapor pressure of water over a surface of water at a given temperature. Relative humidity is normally expressed as a percentage, where a higher percentage means that the air-water mixture is more humid. At 100% relative humidity, the air is saturated and is at its dew point.

According to one aspect of the invention, the object is achieved by means of an outer drive protection arrangement attachable to a marine vessel.

The arrangement comprises a rim portion arranged in contact with at least a transom surface and surrounds at least one outer drive. According to one example, the rim portion can be arranged in contact with the transom surface immediately adjacent and surrounding the outer drive. According to a further example, the rim portion can be arranged in contact with the transom surface spaced from and surrounding the outer drive. According to a further example, the rim portion can be arranged in contact with the transom surface spaced from the outer drive, and further contacting a portion of the hull forward of the transom. A protective cover is attached to the rim portion and encloses a volume encompassing the at least one outer drive, in order to provide a protected gaseous environment inside the cover. The environment contained within the cover is circulated and is maintained at a predetermined atmospheric condition by means of a source of conditioned gas.

The source of conditioned gas is arranged to supply gas at a predetermined humidity to the volume enclosed by the cover in order to condition and circulate the gas inside the cover. Gas supplied to the volume enclosed by the cover can be provided from any suitable external or internal source. Conditioned gas can be received from an external source located remote from the vessel, such as the common ventilation system of a ship or an offshore facility on which the vessel is stored. Alternatively, conditioned gas can be received from a local external air-conditioning (AC) unit near or on-board the vessel, or from an internal AC unit arranged inside the cover. If the source of conditioned gas is the ventilation system within a ship or an offshore facility, then the humidity of the gas is determined by the available ventilation air humidity level. If the source of conditioned gas is an external AC unit adjacent the vessel or an internal AC unit within the cover then the humidity level can be set to a local, desired level by a user. In this context a desired humidity level is below 60% relative humidity, preferably below 50%, in order to provide anti-corrosion protection for the outer drive. An optional humidity sensor can be provided in order to monitor, and if necessary adjust, the humidity level.

The source of conditioned gas can also, or in addition, be arranged to supply gas at a predetermined temperature to the volume enclosed by the cover. If the source of conditioned gas is the ventilation system within a ship or an offshore facility, then the temperature of the gas is predetermined by the available ventilation air temperature. If the source of conditioned gas is an external AC unit adjacent the vessel or an internal AC unit within the cover then the temperature level can be set to a local desired level. A desired temperature level is at least above 0° C. to avoid freezing of liquids or lubricants within the outer drive. Higher temperatures can be selected in order to assist in starting of the inboard engine of the outer drive. If the source of conditioned gas is the ventilation system within a ship or an offshore facility, then the temperature of the gas is determined by the available ventilation air. A separate heater can be provided if the supply of gas required additional heating. If the source of conditioned gas is an external AC unit adjacent the vessel or an internal AC unit within the cover, then the temperature level can be set to a local desired level provided that the AC unit comprises heating means. An optional temperature sensor can be provided in order to monitor, and if necessary adjust, the temperature level.

The source of conditioned gas is arranged to supply gas to the volume enclosed by the cover at a predetermined pressure at a level exceeding the atmospheric pressure in order to maintain the cover at least partially inflated and spaced from the outer drive. This allows the conditioned gas inside the cover to circulate freely. An optional pressure sensor can be provided in order to monitor the arrangement for leaks or, if necessary, to maintain the pressure level within a predetermined range to keep the cover sufficiently inflated. The pressure can be controlled by, for instance, regulating the flow rate of gas into the cover.

The optional sensors for humidity, temperature and/or pressure can be connected to a control unit and be monitored by a user from a remote location. Alternatively, the control unit can be connected to or integrated in a gas conditioning unit, which unit can regulate the humidity and/or temperature in the volume enclosed by the cover in response to detected values in order to maintain desired values. The unit can regulate the pressure within the cover by controlling the rate of flow of supplied gas, or alternatively by regulating a controllable gas release valve attached to the cover, in order to maintain a desired pressure and degree of inflation of the cover. The unit can also trigger an alarm if the detected pressure indicates an abnormal pressure loss, which in turn indicates that there is a leak in the cover or the gas supply, or that the rim portion has been displaced or incorrectly mounted.

The source of conditioned gas is connected to the volume enclosed by the cover via a supply hose or similar conduit coupled to a suitable connector fixed to the cover at a suitable position. If the conditioned gas is air, then an open loop arrangement can be used. Excess air can be removed from the protection arrangement by means of one or more openings in the form of holes or perforations in the cover, by means of one or more fixed flow or controllable valves, and/or by allowing air to leak through or past the rim portion. In some cases, a controlled, limited leak past the rim portion can be acceptable, as long as sufficient inflation of the cover is maintained. If a visual inspection or a detected pressure signal shows insufficient inflation, this indicates that the rim portion has been incorrectly mounted or has come loose from the transom. The open loop arrangement provides circulation and a through flow of conditioned gas within the cover. Any suitable combination of openings and valves can be used to achieve a desired degree or direction of circulation.

In its simplest application, the protection arrangement could be mounted on an outer drive, where after the engine connected to the drive is operated to fill the cover. This application would not provide dehumidification of the air within the volume, but can provide a basic form of corrosion protection if exhaust gas is the only source available.

If the conditioned gas is an inert gas, such as nitrogen or $CO_2$, then a closed loop arrangement is used. Gas supplied from an atmospheric conditioning device to the cover through a supply hose can be returned to the source via a return hose for treatment before being re-used. The inert gas is treated by drying and/or heating and is then supplied back to the volume enclosed by the cover at a desired humidity level and/or temperature.

Alternatively, the source of conditioned gas is an atmospheric conditioning device comprising at least a dehumidifier arranged adjacent or inside the cover in order to condition and circulate the gas inside the cover. Alternatively, or in addition, a heater arranged inside the cover in order to control the temperature of the gas inside the cover. An atmospheric conditioning device located in close proximity to the inner or outer surface of the cover can be operated by drawing in ambient air, conditioning the air and inflating the cover. Subsequently, spent, humid air can be removed by the device while maintaining the volume inside the cover at a predetermined pressure. The humidity level and/or the temperature of the supplied air can be set by a user and regulated continuously by the device, which is operated in an open-loop mode. A further mode of operation can involve circulation of air inside the cover in a closed-loop mode. The atmospheric conditioning device can switch to the closed-loop mode once a desired humidity and/or temperature has been reached. The closed-loop mode is maintained as long as set values for humidity, temperature and/or pressure are within desired ranges within the cover.

According to a further example, an atmospheric conditioning device comprising at least a dehumidifier arranged adjacent or inside the cover can be connected to a source of inert gas. The atmospheric conditioning device located in close proximity to the inner or outer surface of the cover can be operated by drawing in inert gas from the supply, conditioning the gas and inflating the cover. Subsequently, the device is operated in closed-loop mode to maintain set values for humidity, temperature and/or pressure within desired ranges within the cover. Liquid extracted from humid gas circulated from the cover can be removed through an external drain placed outside the cover. Additional inert gas is drawn from the supply only to supplement gas lost through leakage past the rim portion or diffusion through the cover, and to maintain the pressure within the cover.

During winter conditions or in cold climates, heat loss from the outer drive protection arrangement can be reduced by a heat insulating layer in the cover. The heat insulation can comprise one or more layers having, for instance, spaced channels or pockets containing air, a reflective metallic layer, and/or layers of other suitable heat insulating materials.

The rim portions described above can be manufactured in a number of different ways. According to one example, the rim portion can comprise a solid or hollow metal or plastic profile that is shaped to conform to the surface of at least the transom surrounding the outer drive. A sealing member in the form of a lip or a deformable member made from rubber, synthetic rubber or a suitable foam material can be vulcanized or glued onto the shaped profile.

According to a further example, the rim portion can comprise a resilient or elastic profile made from a plastic, rubber or synthetic rubber material. The profile has a deformable, stiffening core made from a metallic or synthetic material. This rim portion is permanently deformed to conform to the surface of at least the transom surrounding the outer drive. A sealing member in the form of a lip or a deformable member made from rubber, synthetic rubber or a suitable foam material can be vulcanized or glued onto the shaped profile. The sealing member can be made from the same material.

According to a further example, the rim portion can comprise a hollow resilient or elastic profile made from a plastic, rubber or synthetic rubber material. The profile can be provided with a deformable, stiffening core or wire made from a metallic or synthetic material. Alternatively, the profile can be made from a material that retains its shape after a heat treatment and a subsequent shaping process. The profile is shaped to conform to the surface of at least the transom surrounding the outer drive.

The rim portions described in the above examples can have any suitable cross-section, such as square, triangular, round, oval or D-shaped within the scope of the invention.

When the rim portion has been given its desired shape, a flexible and collapsible cover is permanently fixed to the rim portion by a suitable and compatible adhesive. Prior to this step, the cover has been provided with openings, perforations, valve means and one or more connections for supplying and/or removing gas to/from the volume enclosed by the cover, where necessary. Attachment of hoses or conduits to the connections can be achieved by friction connections, with or without clamps, threaded connections, bayonet connections or any other suitable means for removably fixing a hose to a flange or a tubular section provided on the outer surface of the cover.

Mounting of the outer drive protection arrangement to the transom around the outer drive can be achieved in a number of different ways, depending on the cross-sectional and circumferential shape of the rim portion. According to one example, the rim portion can comprise a relatively stiff metal or plastic profile which is only in contact with the transom, or with the transom and a portion of the lower hull extending forwards from the transom. In this case, the rim portion is positioned around and spaced from the outer drive, with or without the aid of one or more guide surfaces, such as projections fixed to at least the transom. A rim portion having a shape that extends under the hull can be positioned using this forwards extension. The transom can be provided with multiple attachment devices, such as spring-loaded clips, excenter clamps or mechanical fasteners, which will interact with the rim portion to hold it in place. The number of attachment devices required is dependent on factors such as the shape and material properties of the outer rim and also on the number and shape of the guide surfaces or projections provided. The guide surfaces can be linear or curved projections extending straight out of the transom, merely for positioning the rim portion, or for instance L-shaped projections conforming to the shape of the rim portion, which projections will position and retain the rim portion against the transom and or the lower part of the hull.

According to one example, the rim portion can comprise a relatively deformable rubber or plastic profile which is in contact with at least the mounting portion of the outer drive adjacent the transom, and alternatively also with the surface transom immediately surrounding the outer drive. In this case, the rim portion is positioned around and in contact with the outer drive, with or without the aid of guide surfaces or projections fixed to at least the transom. The transom and or the mounting portion of the outer drive can be provided with multiple attachment devices, such as spring loaded or resilient clips or clamps, excenter clamps, screws or other mechanical fasteners, which will interact with the rim portion to hold it in place against at least the transom.

The protective cover can be made from any suitable material, such as canvas, synthetic fabric and/or plastic material, that is flexible and collapsible. Depending on the local climate, the material can be selected to retain its properties in temperatures as high as +50° C. and/or as low as −50° C. The material should preferably be UV-resistant and can also be non-flammable. The material should be waterproof, preferably also salt-water resistant, in order to prevent ingress of water, rain and spray that can strike the outer surface of the cover. The cover is preferably, but not necessarily gas tight. A gas tight cover can be required if the enclosed volume is filled with an inert gas being circulated in a closed circuit. However, if the volume is filled with dry and/or heated air that is released to the ambient atmosphere, then a limited amount of gas permeability can be allowed. A non-exhaustive list of materials can comprise, for example, nylon, DACRON®, glass-fiber reinforced plastic, acrylonitrile-butadiene-styrene, nylon mesh fabric coated with Neoprene®, PVC-coated polyester fabric, waterproofed canvas or a cotton duck material. An optional stiffening spiral reinforcement made from a suitable metallic material can be provided to assist in maintaining the cover expanded about the outer drive. The spiral spring can also facilitate packaging of the cover for removal and storage when not in use. Portions of the cover subject to wear can be reinforced locally.

According to one aspect of the invention, the object is achieved by means of a marine vessel that it comprises an outer drive protection arrangement as described above.

An advantage of the invention is that it provides a protection arrangement particularly adapted for use on outer drives on marine vessels during extended periods of non-use, primarily when the marine vessel is stored out of the water whereby the anode protection is disabled. A further advantage is that the protection arrangement is adapted to be fitted around marine equipment in the form of one or more outer drives which under non-use circumstances are stored or transported out of the water, allowing an effective treatment of the atmosphere within the cover to inhibit corrosion and weathering of the drive. A further advantage is that the protection arrangement has an uncomplicated design which serves to protect outer drives on boats, the protection arrangement including a frame supporting a flexible envelope which may be easily fitted over the outer drive. The frame comprises a seal held in gas tight contact with a vessel structure such as a transom and/or a portion of the hull to permit treatment of the atmosphere surrounding the outer drive or drives using treated air or an inert gas for the prevention of corrosive action from water or salt and for inhibition of existing or new marine growth.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples. In the drawings.

DETAILED DESCRIPTION OF EXAMPLE EMBODIMENTS OF THE INVENTION

Figure 1:
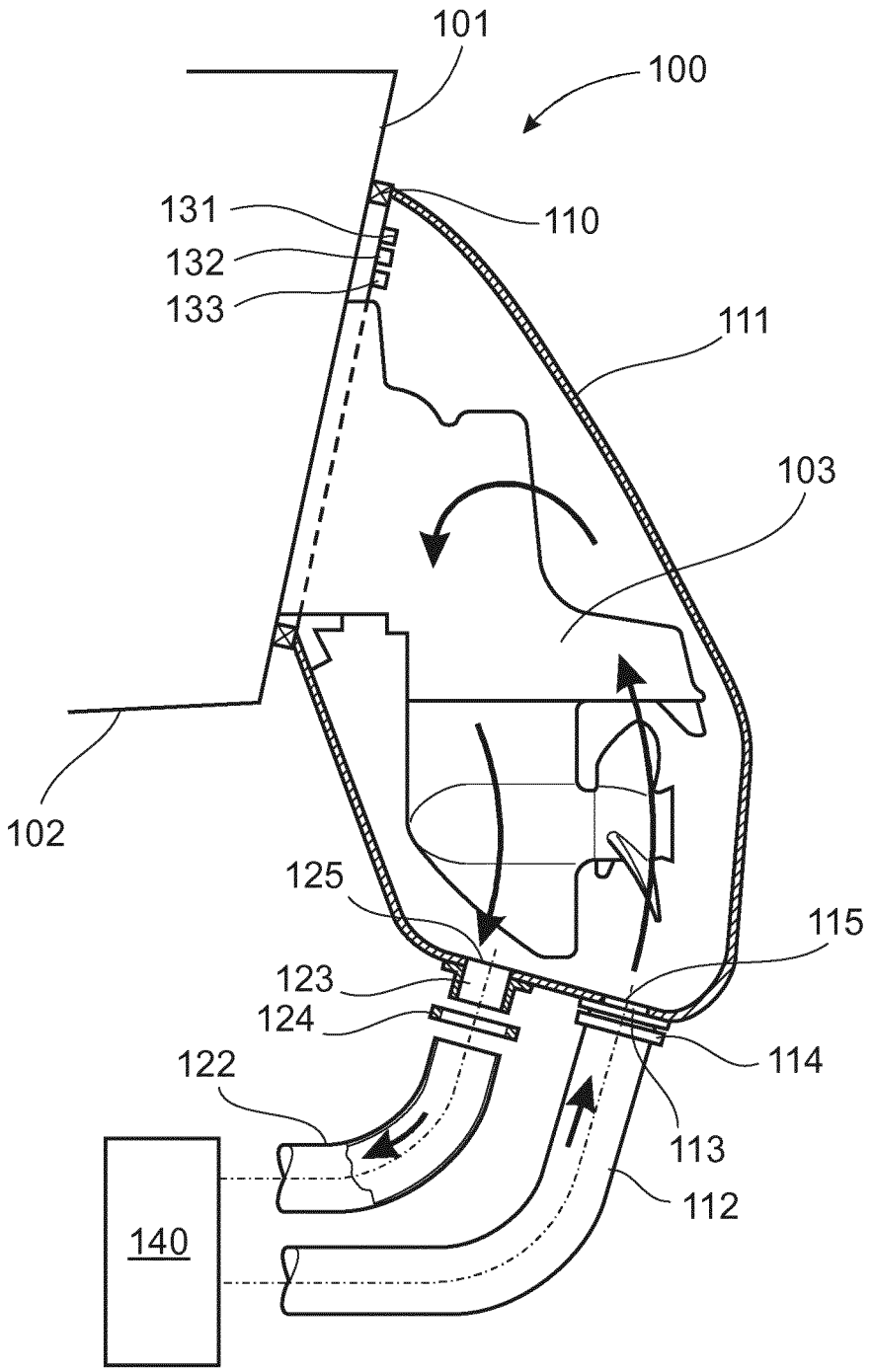
FIG. 1 shows a side view of a marine vessel provided an outer drive protection arrangement according to a first example.

FIG. 1 shows a side view of a marine vessel 100, illustrated by a transom surface 101 and a hull 102, which vessel 100 is provided an outer drive protection arrangement 110, 111 according to a first example. The arrangement comprises a rim portion 110 arranged in contact with the transom surface 101 and surrounding an outer drive 103. According to this example, the rim portion 110 is arranged in contact with the transom surface 101 immediately adjacent and surrounding the outer drive 103. A protective cover 111 is attached to the rim portion 110 and encloses a volume encompassing the outer drive 103, in order to provide a protected gaseous environment inside the cover 111. The environment contained within the cover is circulated and is maintained at a predetermined atmospheric condition by means of a source of conditioned gas 140. The source of conditioned gas 140 is arranged to supply gas at a predetermined humidity to the volume enclosed by the cover 111 in order to condition and circulate the gas inside the cover 111. In the example in FIG. 1, conditioned gas is received from an external source 140 located remote from the vessel, such as the common ventilation system of a ship or an offshore facility on which the vessel is stored. Alternatively, conditioned gas can be received from a local external air-conditioning (AC) unit near or on-board the vessel, or from an internal AC unit arranged inside the cover. If the source of conditioned gas is the ventilation system within a ship or an offshore facility, then the humidity of the gas is determined by the available ventilation air humidity level. If the source of conditioned gas is an external AC unit adjacent the vessel or an internal AC unit within the cover 111 then the humidity level can be set to a local, desired level by a user. In this context a desired humidity level is below 60% relative humidity, preferably below 50%, in order to provide anti-corrosion protection for the outer drive. An optional humidity sensor 131 can be provided in order to monitor, and if necessary adjust, the humidity level.

The source of conditioned gas can also, or in addition, be arranged to supply gas at a predetermined temperature to the volume enclosed by the cover. If the source of conditioned gas is the ventilation system within a ship or an offshore facility, then the temperature of the gas is predetermined by the available ventilation air temperature. If the source of conditioned gas is an external AC unit adjacent the vessel or an internal AC unit within the cover then the temperature level can be set to a local desired level. A desired temperature level is at least above 0° C. to avoid freezing of liquids or lubricants within the outer drive. Higher temperatures can be selected in order to assist in starting of the inboard engine of the outer drive. If the source of conditioned gas is the ventilation system within a ship or an offshore facility, then the temperature of the gas is determined by the available ventilation air. A separate heater (not shown) can be provided if the supply of gas required additional heating. If the source of conditioned gas is an external AC unit adjacent the vessel, then the temperature level can be set to a local desired level provided that the AC unit comprises heating means. An optional temperature sensor 132 is provided in order to allow monitoring, and if necessary adjustment, of the temperature level.

The source of conditioned gas 140 is arranged to supply gas to the volume enclosed by the cover at a predetermined pressure at a level exceeding the atmospheric pressure in order to maintain the cover 111 at least partially inflated and spaced from the outer drive 103. This allows the conditioned gas inside the cover 111 to circulate freely. An optional pressure sensor 133 is provided in order to monitor the arrangement for leaks or, if necessary, to maintain the pressure level within a predetermined range to keep the cover sufficiently inflated. The pressure can be controlled by, for instance, regulating the flow rate of gas into the cover.

The optional sensors for humidity, temperature and/or pressure can be connected to a control unit and be monitored by a user from a remote location. Alternatively, the control unit can be connected to or integrated in a gas conditioning unit, which unit can regulate the humidity and/or temperature in the volume enclosed by the cover in response to detected values in order to maintain desired values. The unit can regulate the pressure within the cover by controlling the rate of flow of supplied gas, or alternatively by regulating a controllable gas release valve attached to the cover, in order to maintain a desired pressure and degree of inflation of the cover. The unit can also trigger an alarm if the detected pressure indicates an abnormal pressure loss, which in turn indicates that there is a leak in the cover or the gas supply, or that the rim portion has been displaced or incorrectly mounted.

The source of conditioned gas 140 is connected to the volume enclosed by the cover via a supply hose 112 coupled to a supply connector 113 fixed by a clamp 114. The supply connector 113 is fixed to the cover 111 at a suitable position, in this case at the lower portion of the cover, to provide an opening 115 into the cover 111. If the conditioned gas is an inert gas, such as nitrogen or CO2, then a closed loop arrangement as shown in FIG. 1 is used. Gas from a source of conditioned gas, such as an atmospheric conditioning device 140, is supplied to the cover 111 through the supply hose 112 is returned to the atmospheric conditioning device 140 via a return hose 122 for treatment before being re-used. The return hose 122 is coupled to an opening 125 in the cover 111 by a return connector 123 fixed by a clamp 124, as indicated in the partially exploded view in FIG. 1. The return connector 123 is fixed to the cover 111 at a suitable position, in this case adjacent the supply connector 113. The inert gas is treated by drying and/or heating and is then supplied back to the volume enclosed by the cover 111 at a desired humidity level and/or temperature.

Figure 2:
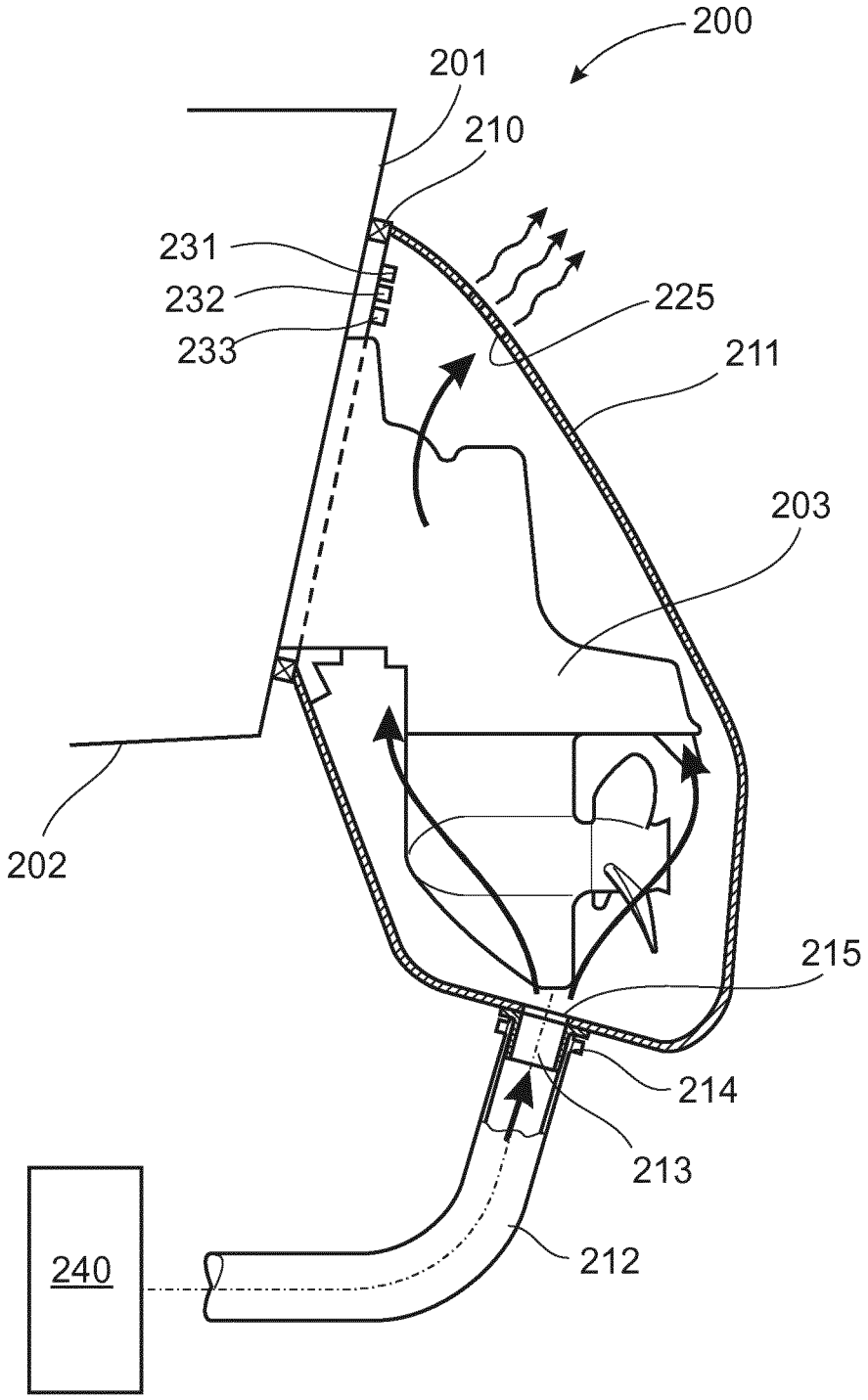
FIG. 2 shows a side view of a marine vessel provided an outer drive protection arrangement according to a second example.

FIG. 2 shows a side view of a marine vessel 200, illustrated by a transom surface 201 and a hull 202, which vessel 200 is provided an outer drive protection arrangement 210, 211 according to a second example. The arrangement comprises a rim portion 210 arranged in contact with the transom surface 201 and surrounding and outer drive 203. According to this example, the rim portion 210 is arranged in contact with the transom surface 201 immediately adjacent and surrounding the outer drive 203. A protective cover 211 is attached to the rim portion 210 and encloses a volume encompassing the outer drive 203, in order to provide a protected gaseous environment inside the cover 211. The environment contained within the cover is circulated and is maintained at a predetermined atmospheric condition by means of a source of conditioned gas 240. The source of conditioned gas 240 is arranged to supply gas at a predetermined humidity to the volume enclosed by the cover 211 in order to condition and circulate the gas inside the cover 211. In the example in FIG. 2, conditioned gas is received from an external source 240 located remote from the vessel, such as the common ventilation system of a ship or an offshore facility on which the vessel is stored. Alternatively, conditioned gas can be received from a local external air-conditioning (AC) unit near or on-board the vessel, or from an internal AC unit arranged inside the cover. If the source of conditioned gas is the ventilation system within a ship or an offshore facility, then the humidity of the gas is determined by the available ventilation air humidity level. If the source of conditioned gas is an external AC unit adjacent the vessel or an internal AC unit within the cover 211 then the humidity level can be set to a local, desired level by a user. In this context a desired humidity level is below 60% relative humidity, preferably below 50%, in order to provide anti-corrosion protection for the outer drive. An optional humidity sensor can be provided in order to monitor, and if necessary adjust, the humidity level.

As in the example shown in FIG. 1, the arrangement in FIG. 2 can be provided with a humidity sensor 231, a temperature sensor 232 and/or a pressure sensor 233 for monitoring and, if necessary, adjusting the conditions within the cover 211.

In the example shown in FIG. 2, the conditioned gas can be air, or a similar gas that can be released to the ambient atmosphere after use. In this case, an open loop arrangement is used. The source of conditioned gas 240 is connected to the volume enclosed by the cover via a supply hose 212 coupled to a supply connector 213 fixed by a clamp 214. The supply connector 213 is fixed to the cover 211 at a suitable position, in this case at the lower portion of the cover, to provide an opening 215 into the cover 211. Excess air is removed from the protection arrangement by means of one or more openings 225 in the form of holes or perforations in the cover. Any suitable combination of positioning and size of the openings can be used to achieve a desired degree or controlled direction of circulation through the cover. The total area of the openings 225 is selected in relation to the available pressure and flow rate of the supplied gas, in order to maintain the cover 211 inflated.

Figure 3:
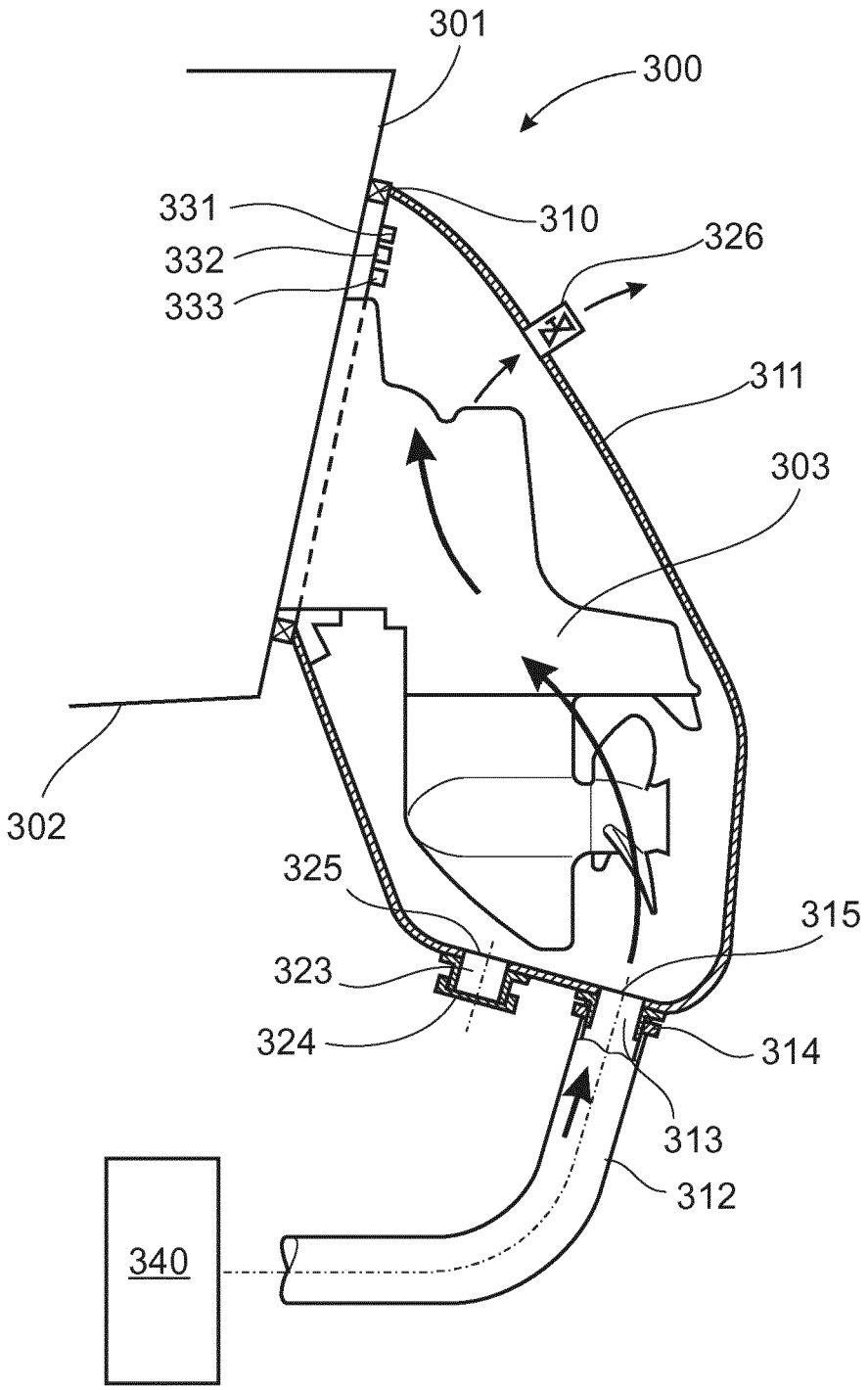
FIG. 3 shows a side view of a marine vessel provided an outer drive protection arrangement according to a third example.

FIG. 3 shows a side view of a marine vessel 300, illustrated by a transom surface 301 and a hull 302, which vessel 300 is provided an outer drive protection arrangement 310, 311 according to a third example. The arrangement comprises a rim portion 310 arranged in contact with the transom surface 301 and surrounding and outer drive 303. According to this example, the rim portion 310 is arranged in contact with the transom surface 301 immediately adjacent and surrounding the outer drive 303. A protective cover 311 is attached to the rim portion 310 and encloses a volume encompassing the outer drive 303, in order to provide a protected gaseous environment inside the cover 311. The environment contained within the cover is circulated and is maintained at a predetermined atmospheric condition by means of a source of conditioned gas 340. The source of conditioned gas 340 is arranged to supply gas at a predetermined humidity to the volume enclosed by the cover 311 in order to condition and circulate the gas inside the cover 311. In the example in FIG. 3, conditioned gas is received from an external source 340 located remote from the vessel, such as the common ventilation system of a ship or an offshore facility on which the vessel is stored. Alternatively, conditioned gas can be received from a local external air-conditioning (AC) unit near or on-board the vessel, or from an internal AC unit arranged inside the cover. If the source of conditioned gas is the ventilation system within a ship or an offshore facility, then the humidity of the gas is determined by the available ventilation air humidity level. If the source of conditioned gas is an external AC unit adjacent the vessel or an internal AC unit within the cover 311 then the humidity level can be set to a local, desired level by a user. In this context a desired humidity level is below 60% relative humidity, preferably below 50%, in order to provide anti-corrosion protection for the outer drive. An optional humidity sensor can be provided in order to monitor, and if necessary adjust, the humidity level.

As in the example shown in FIG. 1, the arrangement in FIG. 3 can be provided with a humidity sensor 331, a temperature sensor 332 and/or a pressure sensor 333 for monitoring and, if necessary, adjusting the conditions within the cover 311.

In the example shown in FIG. 3, the conditioned gas can be air, or a similar gas that can be released to the ambient atmosphere after use. In this case, an open loop arrangement is used. The source of conditioned gas 340 is connected to the volume enclosed by the cover via a supply hose 312 coupled to a supply connector 313 fixed by a clamp 314. The supply connector 313 is fixed to the cover 311 at a suitable position, in this case at the lower portion of the cover, to provide an opening 315 into the cover 311. The arrangement in FIG. 3 can be used for both open loop and closed loop operation. However, in the current example the opening 325 for an optional return conduit (not shown) is closed by means of a closure 324 attached to a return connector 323 attached to the cover 311.

Excess air is removed from the protection arrangement by means of a controllable valve 326. The valve 326 can be adjusted manually or remotely to achieve a desired inflation of the cover 311. Alternatively, any suitable combination of fixed flow valves and/or controllable valves can be used for achieving a desired degree or controlled direction of circulation of conditioned gas through the cover. Air can also be released by allowing air to leak through or past the rim portion 310. According to a further alternative, one or more fixed or controllable valves can be supplemented by one or more openings (see FIG. 2) in the form of holes or perforations in the cover.

Figure 4:
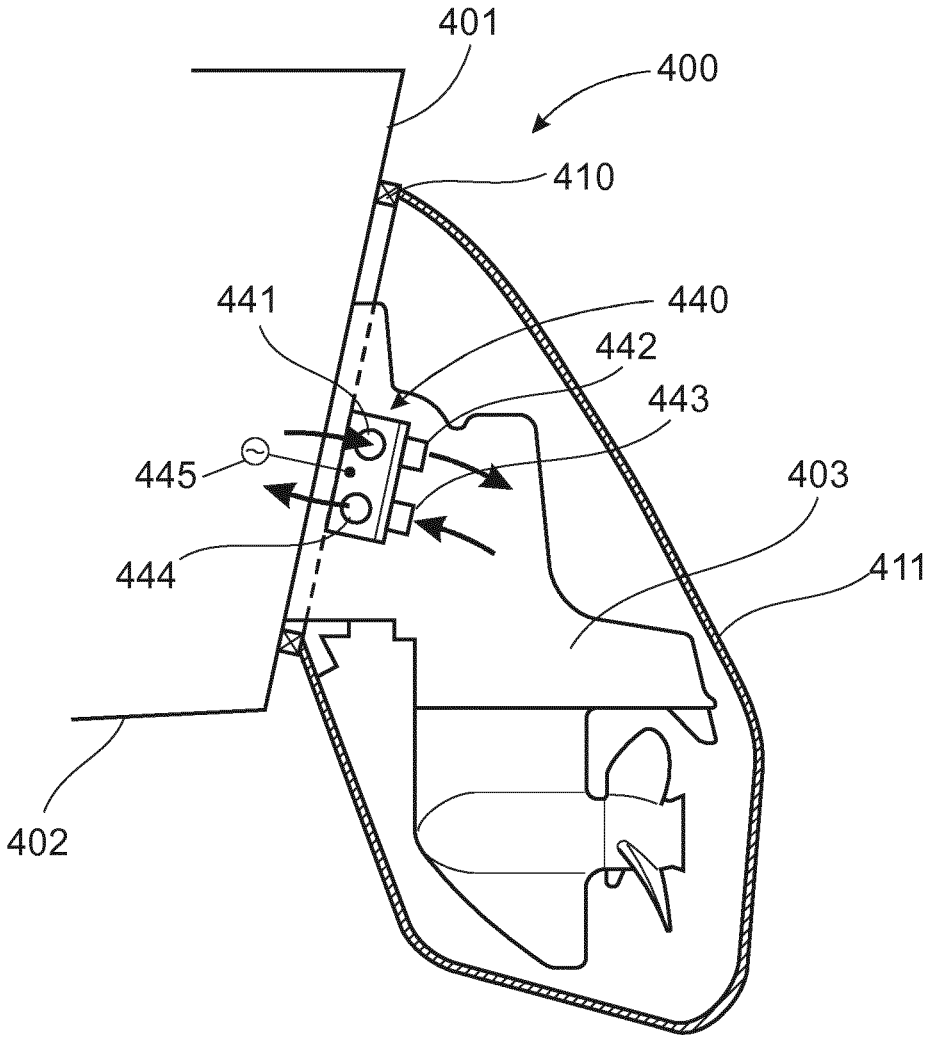
FIG. 4 shows a side view of a marine vessel provided an outer drive protection arrangement according to a fourth example.

FIG. 4 shows a side view of a marine vessel 400, illustrated by a transom surface 401 and a hull 402, which vessel 400 is provided an outer drive protection arrangement 410, 411 according to a second example. The arrangement comprises a rim portion 410 arranged in contact with the transom surface 401 and surrounding and outer drive 403. According to this example, the rim portion 410 is arranged in contact with the transom surface 401 immediately adjacent and surrounding the outer drive 403. A protective cover 411 is attached to the rim portion 410 and encloses a volume encompassing the outer drive 403, in order to provide a protected gaseous environment inside the cover 411. The environment contained within the cover is circulated and is maintained at a predetermined atmospheric condition by means of a source of conditioned gas in the form of an internal AC unit 440 arranged inside the cover 411. The AC unit 440 is connected to a supply of electric power 445. The AC unit 440 is arranged to supply conditioned air at a predetermined humidity to the volume enclosed by the cover 411 in order to condition and circulate the air inside the cover 411. Alternatively, the source of conditioned gas can be a local external air-conditioning unit arranged adjacent an outer surface of the rim portion 410 and/or the cover 411. The AC unit can also be placed on-board the vessel adjacent the protective arrangement. In the example shown in FIG. 4, the humidity of the gas is controlled by the internal AC unit 440 within the cover 411, whereby the humidity level can be set to a local, desired level by a user. In this context a desired humidity level is below 60% relative humidity, preferably below 50%, in order to provide anti-corrosion protection for the outer drive. A humidity sensor can be provided in the internal AC unit 440 in order to monitor, and if necessary adjust, the humidity level. The arrangement in FIG. 4 can also be provided with integrated temperature and/or pressure sensors (not shown) for monitoring and, if necessary, adjusting the conditions within the cover 411.

In the example shown in FIG. 4, the conditioned gas is air which is released to the ambient atmosphere after use. The AC unit 440 is connected to the ambient atmosphere via a supply conduit 441 extending through the cover 411. Conditioned air is blown into the cover 411 through an air supply port 442 on the AC unit 440 and excess air is withdrawn through a return port 443. Spent air is expelled from the AC unit 440 through an exit port 444 extending through the cover 411. The flow rate through the AC unit 440 is controllable in order to maintain the cover 211 inflated. Alternatively, the AC unit can be combined with multiple openings and/or valves in the cover to achieve a desired degree or controlled direction of circulation through the cover.

FIGS. 5-9 show a number of non-limiting examples of different ways of positioning the protective arrangement relative to the hull and outer drive or drives of a marine vessel.

Figure 5:
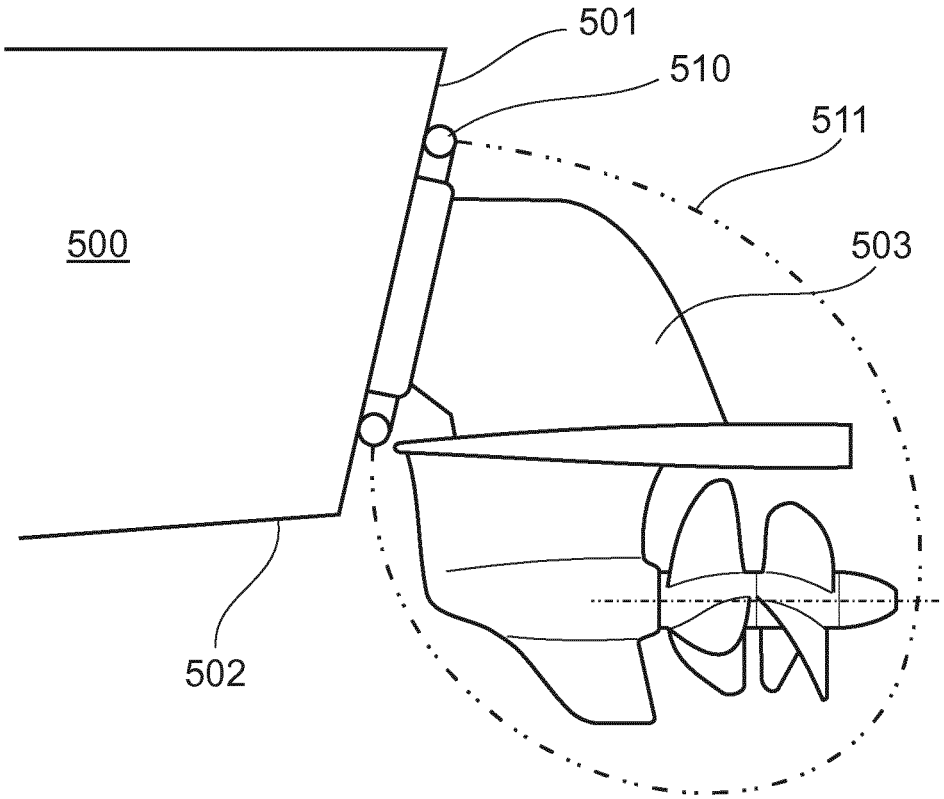
FIG. 5 shows a side view of a protective cover according to a first example.
Figure 7:
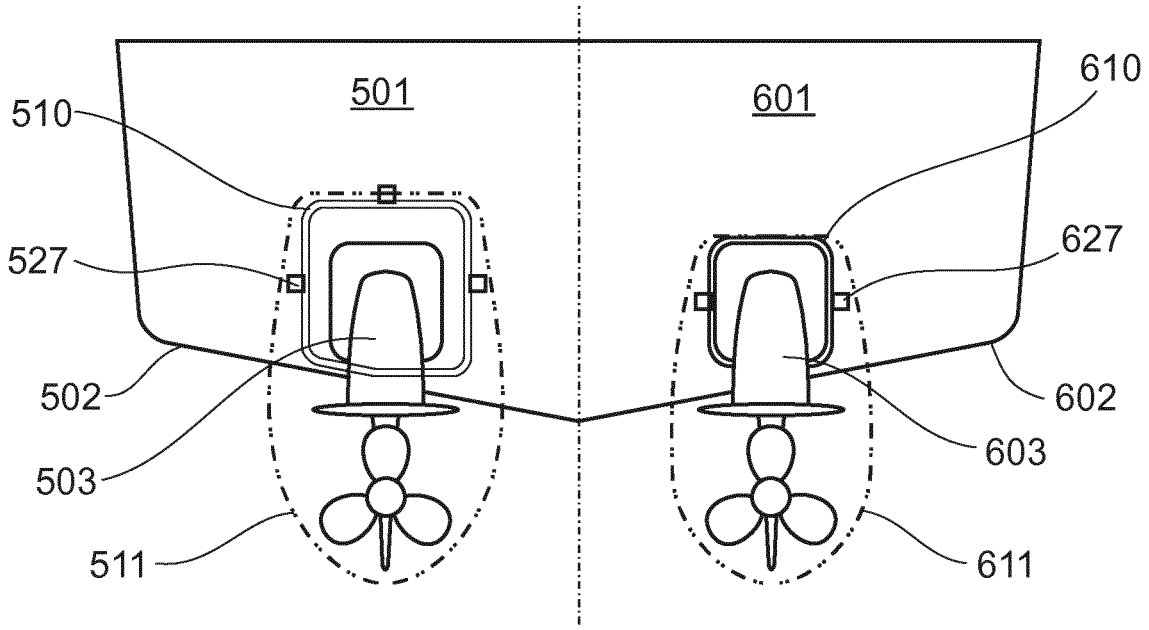
FIG. 7 shows a rear view of the protective covers shown in FIGS. 5 and 6.

FIG. 5 shows a side view of a marine vessel 500, illustrated by a transom surface 501 and a hull 502, which vessel 500 is provided an outer drive protection arrangement 510, 511 according to a first example. According to this example, the rim portion 510 is arranged in contact with the transom surface 501 spaced from and surrounding the outer drive 503. The rim portion 510 is spaced from and out of contact with a mounting plate of the outer drive 503 over at least a major part of its extension. Local contact can occur where it is desired to use a part of the outer drive 503 to position the rim portion 510 relative to the transom surface 501 and the outer drive 503 during mounting of the protective arrangement. Additional means for positioning and fastening 527 the protective arrangement can be provided in or on the transom surface. FIG. 7 (see the left-hand side) shows a rear view of the protective cover 511 in FIG. 5 when mounted on the transom 501.

Figure 6:
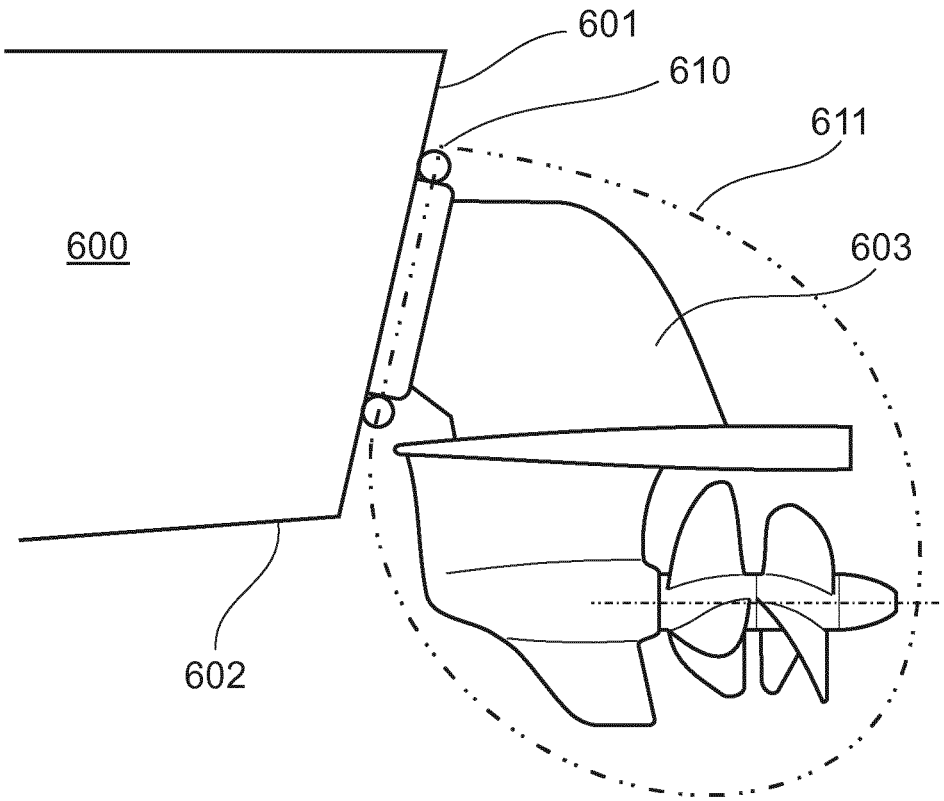
FIG. 6 shows a side view of a protective cover according to a second example.

FIG. 6 shows a side view of a marine vessel 600, illustrated by a transom surface 601 and a hull 602, which vessel 600 is provided an outer drive protection arrangement 610, 611 according to a second example. According to this example, the rim portion 610 is arranged in contact with the transom surface 601 immediately adjacent and surrounding a mounting plate of the outer drive 603 over at least a major part of its extension. The outer drive 603 is thereby used to position the rim portion 610 relative to the transom surface 601 and the outer drive 603 during mounting of the protective arrangement. Additional means for fastening 627 the protective arrangement can be provided in or on the transom surface. FIG. 7 (see the right-hand side) shows a rear view of the protective cover 611 in FIG. 6 when mounted on the transom 601.

Figure 8:
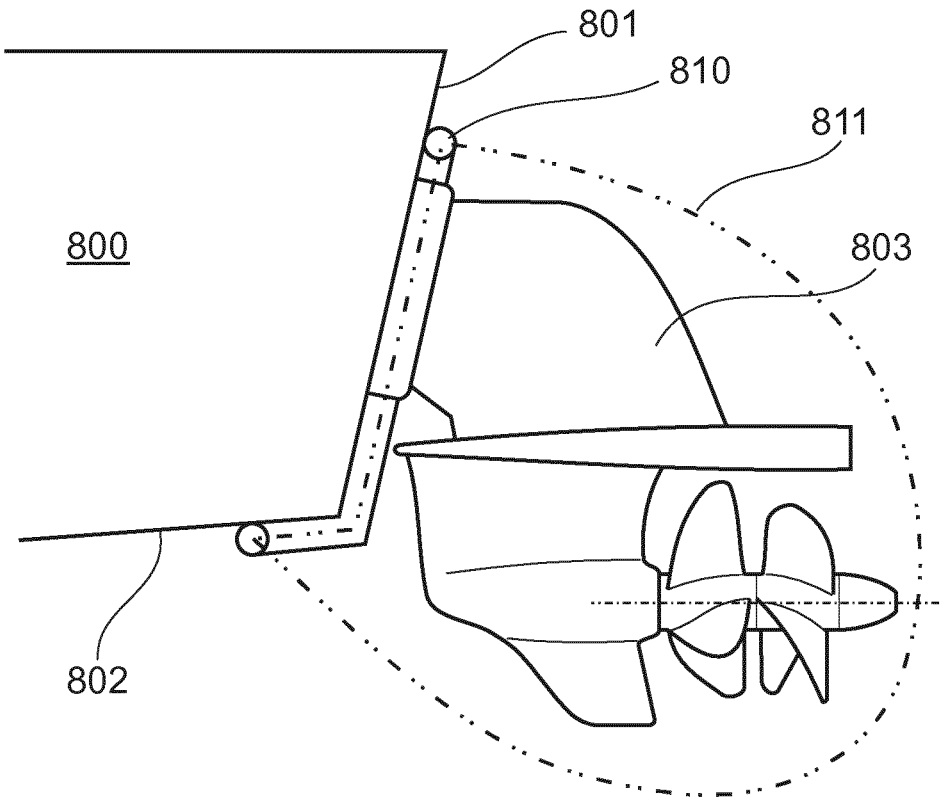
FIG. 8 shows a side view of a protective cover according to a third example.

FIG. 8 shows a side view of a marine vessel 800, illustrated by a transom surface 801 and a hull 802, which vessel 800 is provided an outer drive protection arrangement 810, 811 according to a third example. According to this example, the rim portion 810 is arranged in contact with the transom surface 801 spaced from the outer drive 803. The rim portion 810 further extends into contact with a lower portion of the hull 802 a predetermined distance along the hull forward of the transom surface 801. The part of the rim portion 810 extending forward of the transom surface 801 is used to position the rim portion 810 relative to the transom surface 801 and the outer drive 803 during mounting of the protective arrangement. Additional means for fastening (not shown) the protective arrangement can be provided in or on the transom surface.

Figure 9:
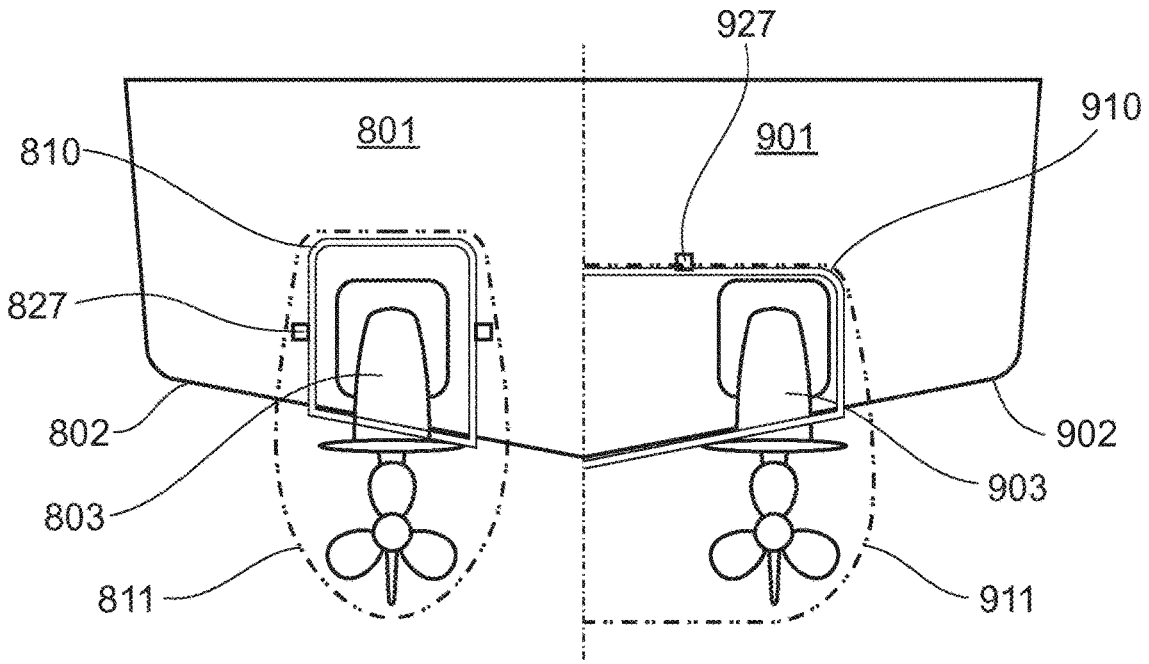
FIG. 9 shows a rear view of two versions of the protective cover shown in FIG. 8.

FIG. 9 shows a rear view of two alternative versions of the protective cover 811 in FIG. 8 when mounted on the transom 801. FIG. 9 (see the left-hand side) shows a rear view of a first alternative version of the protective cover shown in FIG. 8, wherein a protective cover comprising a rim portion 810 and a cover 811 encloses a single outer drive 803. Additional means for fastening 827 the protective arrangement can be provided in or on the transom surface. FIG. 9 (see the right-hand side) shows a rear view of a first alternative version of the protective cover shown in FIG. 8, wherein a protective cover comprising a rim portion 910 and a cover 911 encloses a single outer drive 903. In the latter example, the rim portion 910 is arranged in contact with the transom surface 901 spaced from the outer drive 903. The rim portion 910 further extends into contact with a lower portion of the hull 902 a predetermined distance forward of the transom surface 901, on either side of a pair of drive units 903. Additional means for fastening 927 the protective arrangement can be provided in or on the transom surface.

The examples shown in FIG. 9 are both provided with rim portions 810, 910 spaced at least in part from the respective outer drives 803, 903, as described in connection with FIG. 5 above. However, the rim portions 810, 910 can also be arranged in contact with the respective outer drives 803, 903, as described in connection with FIG. 6.

FIG. 10A-10D show cross-sections of a number of non-limiting examples of rim portions according to the invention. The rim portions described below can be manufactured in a number of different ways.

Figure 10A:
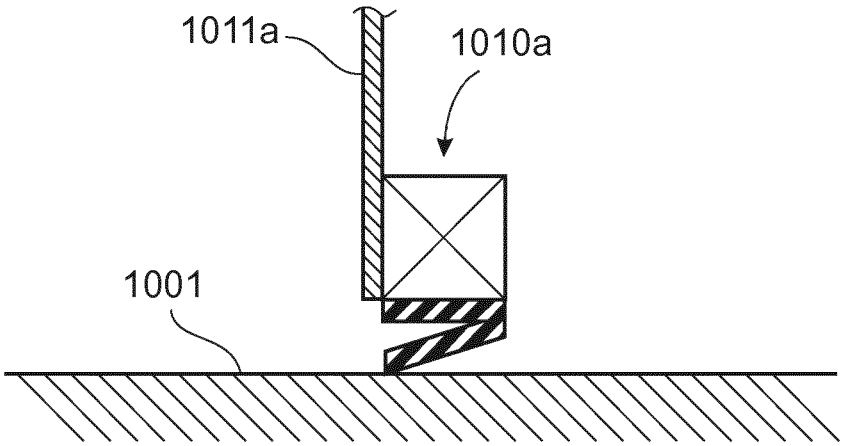
FIG. 10A-D show cross-sections of different embodiments of rim portions according to the invention.

FIG. 10A shows a cross-section of a rim portion 1010*a* according to a first example, where the rim portion comprises a solid or hollow metal or plastic profile that is shaped to conform to a transom surface 1001 around at least the part of the transom surrounding the outer drive. A sealing member in the form of a lip made from rubber or synthetic rubber can be vulcanized or glued onto the shaped profile. A protective cover 1011*a* can be attached to any suitable surface of the rim portion 1010*a*, for instance an outer surface of the rim portion 1010*a* relative to a volume enclosed by the cover 1011*a* as shown in FIG. 10A.

Figure 10B:
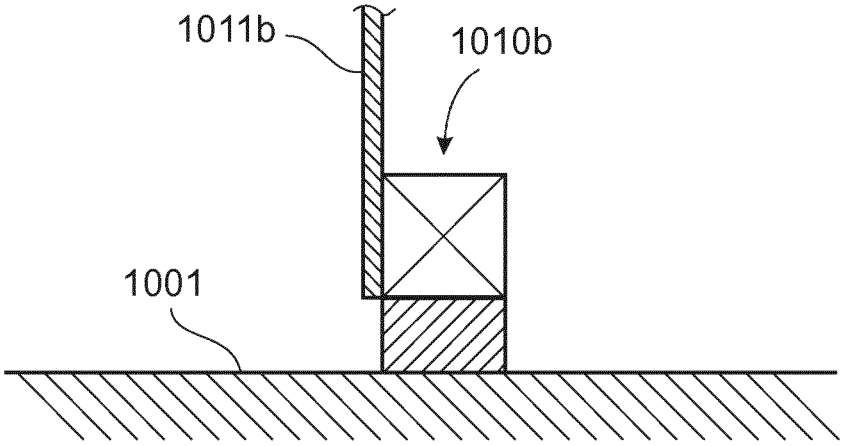

FIG. 10B shows a cross-section of a rim portion 1010*b* according to a second example, where the rim portion comprises a solid or hollow metal or plastic profile that is permanently deformed to conform to a transom surface 1001 around at least the part of the transom surrounding the outer drive. A sealing member in the form of a deformable member made from rubber, synthetic rubber or a suitable foam material can be vulcanized or glued onto the shaped profile. A protective cover 1011*b* can be attached to any suitable surface of the rim portion 1010*b*, for instance an outer surface of the rim portion 1010*b* relative to a volume enclosed by the cover 1011*b* as shown in FIG. 10B.

Figure 10C:
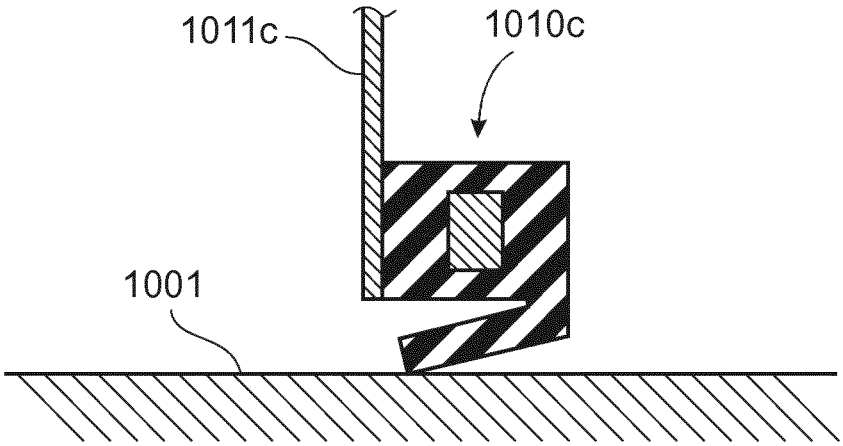

FIG. 10C shows a cross-section of a rim portion 1010*c* according to a third example, where the rim portion comprises a resilient or elastic profile made from a plastic, rubber or synthetic rubber material. The profile has a deformable, stiffening core made from a metallic or synthetic material. This rim portion 1010*c* is permanently deformed to conform to a transom surface 1001 around at least the part of the transom surrounding the outer drive. A sealing member in the form of a lip or a deformable member made from rubber, synthetic rubber or a suitable foam material can be vulcanized or glued onto the shaped profile. FIG. 10C shows a sealing member in the form of a lip integrated with the shaped profile. The sealing member can be made from the same material as the outer resilient or elastic profile. A protective cover 1011*c* can be attached to any suitable surface of the rim portion 1010*c*, for instance an outer surface of the rim portion 1010*c* relative to a volume enclosed by the cover 1011*c* as shown in FIG. 10C.

Figure 10D:
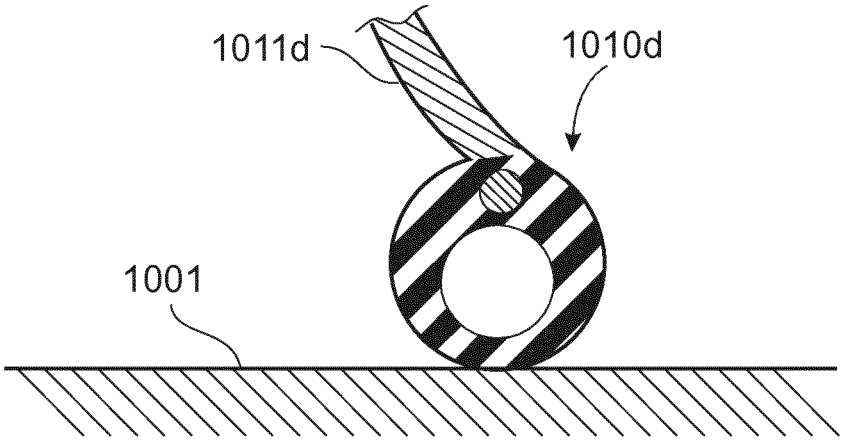

FIG. 10D shows a cross-section of a rim portion 1010*d* according to a third example, where the rim portion can comprise a hollow resilient or elastic profile made from a plastic, rubber or synthetic rubber material. The profile can be provided with a deformable, stiffening core or wire made from a metallic or synthetic material integrated with a wall portion of the hollow profile, as indicated in FIG. 10D. Alternatively, the profile can be made from a material that retains its shape after a heat treatment and a subsequent shaping process. The profile is shaped to conform to the surface of at least the transom surface 1001 surrounding the outer drive. A protective cover 1011*d* can be attached to any suitable surface of the rim portion 1010*d*, for instance an outer surface of the rim portion 1010*d* relative to a volume enclosed by the cover 1011*d* as shown in FIG. 10D.

With reference to the above figures, when the rim portion has been given its desired shape, a flexible and collapsible cover is permanently fixed to the rim portion by a heating process or by a suitable and compatible glue or adhesive. Prior to this step, the cover has been provided with openings, perforations, valve means and one or more connections for supplying and/or removing gas to and from the volume enclosed by the cover, which components have been described above. Attachment of hoses or conduits to the connections fixed to the cover can be achieved by friction or force-fit connections, with or without clamps, threaded connections, bayonet connections or any other suitable means for removably fixing a hose to a flange or a tubular section provided on the outer surface of the cover.

The protective cover can be made from any suitable material, such as canvas, synthetic fabric and/or plastic material, that is flexible and collapsible. Depending on the local climate, the material can be selected to retain its properties in temperatures as high as +50° C. and/or as low as −50° C. The material should preferably be UV-resistant and can also be non-flammable. The material should be waterproof, preferably also salt-water resistant, in order to prevent ingress of water, rain and spray that can strike the outer surface of the cover. The cover is preferably, but not necessarily gas tight. A gas tight cover can be required if the enclosed volume is filled with an inert gas being circulated in a closed circuit. However, if the volume is filled with dry and/or heated air that is released to the ambient atmosphere, then a limited amount of gas permeability can be allowed. A non-exhaustive list of materials can comprise, for example, nylon, DACRON®, glass-fiber reinforced plastic, acrylonitrile-butadiene-styrene, nylon mesh fabric coated with Neoprene®, PVC-coated polyester fabric, waterproofed canvas or a cotton duck material. An optional stiffening spiral reinforcement made from a suitable metallic material can be provided to assist in maintaining the cover expanded about the outer drive. The spiral spring can also facilitate packaging of the cover for removal and storage when not in use. Portions of the cover subject to wear can be reinforced locally.

Mounting of the outer drive protection arrangement to the transom around the outer drive can be achieved in a number of different ways, depending on the cross-sectional and circumferential shape of the rim portion. According to one example, the rim portion can comprise a relatively stiff metal or plastic profile which is only in contact with the transom, or with the transom and a portion of the lower hull extending forwards from the transom. In this case, the rim portion is positioned around and spaced from the outer drive, with or without the aid of one or more guide surfaces, such as projections fixed to at least the transom. A rim portion having a shape that extends under the hull can be positioned using this forwards extension. The transom can be provided with multiple attachment devices, such as spring loaded clips, excenter clamps, rotated clamps or mechanical fasteners, which will interact with the rim portion to hold it in place. The number of attachment devices required is dependent on factors such as the shape and material properties of the outer rim and also on the number and shape of the guide surfaces or projections provided. The guide surfaces can be linear or curved projections extending straight out of the transom, merely for positioning the rim portion, or for instance L-shaped projections conforming to the shape of the rim portion, which projections will position and retain the rim portion against the transom and or the lower part of the hull. Within the scope of the invention, any combination of such clamps and/or guides can be used for fixing the arrangement in place.

During mounting, the rim portion and the protective cover is lifted over the at least one outer drive, where after the deformed rubber or plastic profile making up the rim portion is placed in contact with the transom surface surrounding the outer drive. The rim portion is positioned around and in contact with the outer drive with or without the aid of guide surfaces or projections (not shown) fixed to at least the transom. The transom and or the mounting portion of the outer drive can be provided with multiple attachment devices, such as spring loaded or resilient clips or clamps, excenter clamps, screws or other mechanical fasteners, which will interact with the rim portion to hold it in place against at least the transom. Once the protection arrangement is attached, a hose connected to a source of conditioned gas is attached to the cover. Where required, a return hose is attached. Where the protection arrangement includes its own conditioning unit, this unit is connected to a supply of electric power. The protection arrangement is then operable for protecting the outer drive. Prior to launching the vessel, the above procedure is carried out in reverse to remove the rim portion and cover.

It is to be understood that the present invention is not limited to the embodiments described above and illustrated in the drawings; rather, the skilled person will recognize that many changes and modifications may be made within the scope of the appended claims.

The invention claimed is:

1. A marine vessel, comprising an outer drive protection including a rim portion arranged in contact with at least a transom surface and surrounding at least one outer drive and a protective cover attached to the rim portion and enclosing a volume encompassing the at least one outer drive, in order to isolate the at least one outer drive from ambient air surrounding the outer drives; wherein the arrangement provides a protective gaseous environment inside the cover; wherein the gaseous environment contained within the cover is circulated and maintained at a predetermined atmospheric condition by means of a source of conditioned gas, and wherein the source of conditioned gas is an atmospheric conditioning device comprising at least a dehumidifier arranged adjacent or inside the cover to condition the gas inside the cover.

2. The marine vessel according to claim 1, wherein the source of conditioned gas is arranged to supply gas at a predetermined humidity to the volume enclosed by the cover in order to condition the gas inside the cover.

3. The marine vessel according to claim 1, characterized in that the source of conditioned gas is arranged to supply gas at a predetermined temperature to the volume enclosed by the cover in order to condition the gas inside the cover.

4. The marine vessel according to claim 1, wherein the source of conditioned gas is connected to the volume enclosed by the cover via a supply hose.

5. The marine vessel according to claim 1, wherein the source of conditioned gas is an atmospheric conditioning device comprising a heater arranged inside the cover to condition the gas inside the cover.

6. The marine vessel according to claim 1, wherein the cover comprises at least one opening and/or a gas release valve connected to the ambient atmosphere in order to provide a throughflow of conditioned gas.

7. The marine vessel according to claim 1, wherein the source of conditioned gas is connected to the volume enclosed by the cover via a return hose.

8. The marine vessel according to claim 7, wherein the conditioned gas is an inert gas.

9. The marine vessel according to claim 1, wherein the cover comprises a heat insulating layer.

10. The marine vessel according to claim 1, wherein the arrangement comprises a temperature sensor for detecting the temperature inside the cover.

11. A marine vessel, comprising an outer drive protection including a rim portion arranged in contact with at least a transom surface and surrounding at least one outer drive and a protective cover attached to the rim portion and enclosing a volume encompassing the at least one outer drive, in order to isolate the at least one outer drive from ambient air surrounding the outer drives; wherein the arrangement provides a protective gaseous environment inside the cover; wherein the gaseous environment contained within the cover is circulated and maintained at a predetermined atmospheric condition by means of a source of conditioned gas, the cover comprises at least one opening and/or a gas release valve connected to the ambient atmosphere in order to provide a throughflow of the conditioned gas, wherein the conditioned gas is air.

12. A marine vessel, comprising an outer drive protection including a rim portion arranged in contact with at least a transom surface and surrounding at least one outer drive and a protective cover attached to the rim portion and enclosing a volume encompassing the at least one outer drive, in order to isolate the at least one outer drive from ambient air surrounding the outer drives; a humidity sensor for detecting the humidity of the gas inside the cover; wherein the arrangement provides a protective gaseous environment inside the cover; wherein the gaseous environment contained within the cover is circulated and maintained at a predetermined atmospheric condition by means of a source of conditioned gas.

13. A marine vessel, comprising an outer drive protection including a rim portion arranged in contact with at least a transom surface and surrounding at least one outer drive and a protective cover attached to the rim portion and enclosing a volume encompassing the at least one outer drive, in order to isolate the at least one outer drive from ambient air surrounding the outer drives; a pressure sensor for detecting the pressure inside the cover; wherein the arrangement provides a protective gaseous environment inside the cover; wherein the gaseous environment contained within the cover is circulated and maintained at a predetermined atmospheric condition by means of a source of conditioned gas.

* * * * *